United States Patent [19]

Kobelt

[11] 4,235,016

[45] Nov. 25, 1980

[54] SAFETY SCISSORS

[76] Inventor: Theodore W. Kobelt, Plains Road, Box 122, Wallkill, N.Y. 12589

[21] Appl. No.: 33,385

[22] Filed: Apr. 26, 1979

[51] Int. Cl.[3] ..... B26B 29/04

[52] U.S. Cl. ..... 30/233

[58] Field of Search ..... 30/233, 254

[56] References Cited

U.S. PATENT DOCUMENTS

| | | | |
|---|---|---|---|
| 1,279,389 | 9/1918 | Malsin | 30/233 |
| 1,284,419 | 11/1918 | Moody | 30/233 |
| 2,272,753 | 2/1942 | Steinhardt | 30/233 |
| 2,557,553 | 6/1951 | Metzger | 30/233 |
| 2,591,740 | 4/1952 | Stilwell | 30/233 |

*Primary Examiner*—Jimmy C. Peters

*Attorney, Agent, or Firm*—John Maier, III

[57] ABSTRACT

A guard member is secured at one end adjacent the pivot point of a pair of scissor blades having opposed cutting edges. The guard member extends away from the cutting edge at an acute angle and downward to form a narrow slot at the outside edge of the cutting blade forming an open space between the guard member and a substantial portion of the cutting edge.

3 Claims, 3 Drawing Figures

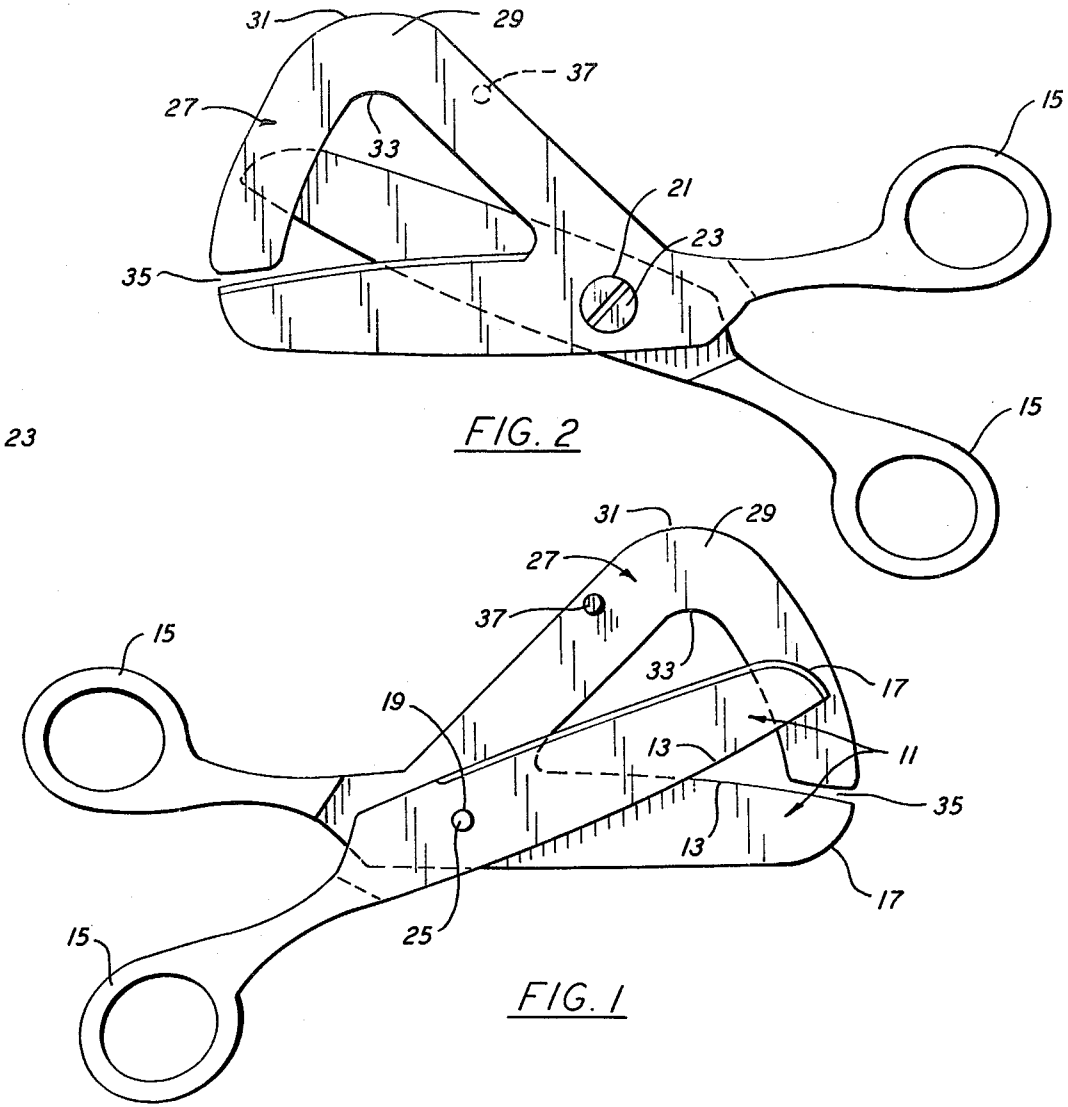
FIG. 2
FIG. 1
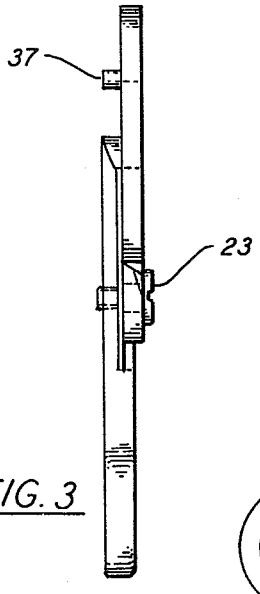
FIG. 3

SAFETY SCISSORS

BACKGROUND OF THE INVENTION

Numerous varieties of safety scissors have been developed for children. Most of these safety scissors provide only a narrow slot through which the material to be cut can be placed. This limits the cutting capacity of the scissors to a single sheet of paper and prevents the cutting of larger objects. The reason apparently is to prevent small children from placing their fingers into the scissors and cutting them off. In addition, it is essential that the safety scissors have blunt ends to prevent a child from jabbing the scissors into either themselves or into someone else.

Due to illness, certain users of scissors, even adults, require a safety scissors. Such persons have a disorder causing the user to have sudden seizures. During these seizures, the user forces whatever object is in their hand into themselves particularly into their face and eyes. However, these same people are capable properly of utilizing the scissors for a wide variety of uses except when such a seizure occurs. A complete confinement of the blade by providing only a narrow slot is not needed and is overly restrictive. Still protection is required so that in the event a seizure does occur, a severe injury or blindness and even death cannot result from the scissors.

This invention relates to improvements in safety scissors and in particular to a safety scissors which provides safety from jabbing into the user due to a seizure but still providing a scissors capable of the broadest possible use. Examples of safety scissors shown in the prior art are as follows:

Malsin—U.S. Pat. No. 1,279,389
Moody—U.S. Pat. No. 1,284,419
Steinhardt—U.S. Pat. No. 2,272,753
Metzger—U.S. Pat. No. 2,557,553
Stilwell—U.S. Pat. No. 2,591,740

SUMMARY OF THE INVENTION

The present invention provides an improved form of safety scissors which prevents injury to the user from jabbing sharp ends of the scissors into the user due to an involuntary reflex while at the same time providing a pair of scissors that can be readily used for cutting more than just a thin piece of paper. The safety scissors contemplated are simple and inexpensive to construct and provide the greatest flexibility of use with the required safety.

The novel features which are considered as characteristic of the invention are set forth with particularity in the appended claims. A pair of scissor blades, each having opposed cutting edges and operating handles, are provided. These are pivotedly connected to one another by a pivot means. A guard means having a general V-shape extends from one of the pair of scissors at an acute angle to the cutting edge of that blade. At the apex of the V, the guard member bends back toward the cutting edge forming a narrow slot of limited length along only a minor portion of the cutting edge toward its outside end. In this way, objects other than a sheet of paper can be placed inside the blade and cut.

The invention itself, however, as to its construction and obvious advantages will be best understood from the following description of the specific embodiment when read with the accompanying drawings.

DESCRIPTION OF THE DRAWINGS

FIG. 1 is a side elevational view of the safety scissors.

FIG. 2 is a side elevational view of the opposite side of the safety scissors from that shown in FIG. 1.

FIG. 3 is an end elevation of the safety scissors.

DETAILED DESCRIPTION OF THE PREFERRED EMBOIDMENTS OF THE INVENTION

Although the description hereof is detailed and exact to enable those skilled in the art to practice the invention, the physical embodiments herein disclosed merely exemplify the invention which may be embodied in other specific structures. The scope of the invention is defined in the claims appended hereto.

As best seen in FIG. 1, a pair of scissor blades 11 is provided. Each of the pair of scissor blades 11 includes a cutting edge 13 and an operating handle 15. Each of the cutting edges 13 has an outside end 17 which is rounded for safety reasons. Substantially in the middle of each of the pair of scissor blades 11 between the cutting edges 13 and the operating handles 15 is a pivot point 19 formed by an opening 21 in one of the pair of blades 11 through which a threaded screw 23 with a slotted flat head is placed. The other one of the pair of scissor blades 11 has a threaded opening 25 with which the threaded screw 31 is engaged. When tightened down, the one scissor blade 11 having the opening 21 rotates about the threaded screw 23 causing a pivoting relationship between the pair of scissor blades 11. A cutting operation results from the engagement of the pair of cutting edges 13.

Substantially shaped like a V but in an inverted position, a guard member 27 includes an apex 29 which is rounded both at its outer area 31 and inner area 33. The guard member 27 which is in the form of a bar similar in size and width to the scissor blades is connected to one of the pair of scissors blades 11 substantially where the pivot point 19 is located. The guard member 27 extends on an acute angle from the scissor blade 11 to which it is secured upwardly and toward the outside end 17 of the cutting edge 13 and then extends downwardly from the apex 29 toward the cutting edge again. The guard member 27 does not touch the cutting edge 13 but rather defines a narrow slot 35 with the cutting edge 13 of the blade 11 to which it is secured but only along a small portion of that scissor blade 11 and adjacent its outside end 17. The size of the slot 35 must be sufficiently small so that the slot 35 cannot fit over the bridge of the nose of the user thereby preventing the scissor blades 11 from entering the eyes of the user. The inner area 33 of the apex 29 is sufficiently removed from the cutting edge 13 of the scissor blade 11 to which it is secured to permit comparatively large objects to be cut with the scissors.

A stop 37 is provided on the guard member 27 to prevent the pair of scissor blades 11 from opening too wide thereby leaving the outside end 17 of one of the pair of scissor blades 11 exposed. The stop 37 is located between the point where the guard member 27 is secured to the scissor blade 11 and the apex 29 but toward the apex 29. The stop 37 is essentially a peg extended outwardly and aligned and parallel with the threaded screw 23. In this way, when the other scissor blades are open, the one blade strikes the stop and cannot open further.

The invention may be embodied in other specific forms without departing from the spirit or essential characteristics thereof. The present embodiments are, therefore, to be considered in all aspects as illustrative and not restrictive. The scope of the invention being indicated by the appended claims rather than the foregoing description and all changes which come within the meaning of range of equivalency of the claims are, therefore, intended to be embraced therein.

I claim:

1. Safety scissors comprising:

a pair of scissor blades each having opposed cutting edges and operating handles, each of the pair of scissor blades having an outside end;

pivot means for pivotably connecting said pair of scissor blades together, said pivot means being located between said opposed cutting edges and operating handles;

a guard member generally having a V-shape and rigidly connected at one end to one of said pair of scissor blades from a point substantially adjacent said pivot means and extending therefrom away from the scissor blade at an acute angle to the cutting edge up to an apex point and from there back toward said scissor blade at its outside end and defining a narrow slot with a minor portion of said scissor blade adjacent said outside end; and stop means secured to said guard member to prevent the opposing scissor blade from opening beyond the guard member.

2. A safety scissor according to claim 1 wherein said apex of said guard member is rounded.

3. A safety scissor according to claim 1 wherein said stop means is a peg secured to said guard member.

* * * * *